US011319114B2

(12) United States Patent
Butterfield et al.

(10) Patent No.: US 11,319,114 B2
(45) Date of Patent: May 3, 2022

(54) TWO-PANEL BAG WITH A TIE HANDLE

(71) Applicant: Bob Barker Company, Inc., Fuquay-Varina, NC (US)

(72) Inventors: Lena Renee Butterfield, Apex, NC (US); Erin Paige Howell, Angier, NC (US); Gerrad Stephen Allison, Angier, NC (US)

(73) Assignee: BOB BARKER COMPANY, INC., Fuquay-Varina, NC (US)

( * ) Notice: Subject to any disclaimer, the term of this patent is extended or adjusted under 35 U.S.C. 154(b) by 0 days.

(21) Appl. No.: 16/848,293

(22) Filed: Apr. 14, 2020

(65) Prior Publication Data

US 2021/0316905 A1 Oct. 14, 2021

(51) Int. Cl.
*B65D 33/16* (2006.01)
*B65D 33/06* (2006.01)

(52) U.S. Cl.
CPC ..... *B65D 33/1608* (2013.01); *B65D 33/065* (2013.01)

(58) Field of Classification Search
CPC ..... B65D 33/1608; B65D 33/065
USPC ..... 383/10, 25, 77
See application file for complete search history.

(56) References Cited

U.S. PATENT DOCUMENTS 3,931,886 A * 1/1976 Yamauchi ..... A61J 9/001 206/390
4,125,220 A * 11/1978 Suominen ..... B65D 33/08 383/9
4,717,262 A * 1/1988 Roen ..... B65D 31/08 383/104
4,925,438 A * 5/1990 Wagner ..... B65D 31/10 493/194
D325,469 S 4/1992 Kim
6,220,753 B1 * 4/2001 Metzger ..... B65D 33/00 220/495.11
D861,346 S 10/2019 Hassler
D864,573 S 10/2019 Jones
D864,754 S 10/2019 Sanchez et al.
2006/0177160 A1 * 8/2006 Wagner ..... B65D 33/1608 383/118
2010/0129007 A1 * 5/2010 McCoy ..... B65D 33/14 383/7
2016/0159524 A1 * 6/2016 Rosenburg ..... B65D 33/065 383/8

FOREIGN PATENT DOCUMENTS

GB 2208843 A * 4/1989 ..... B65D 33/1608
JP 11035102 A * 2/1999 ..... B65D 33/1608

OTHER PUBLICATIONS

Machine translation of JP-11035102-A.*

* cited by examiner

*Primary Examiner* — Jes F Pascua
(74) *Attorney, Agent, or Firm* — Coats & Bennett, PLLC

(57) ABSTRACT

A two-panel bag constructed from first and second panels that each has the same shape and size. The panels are connected together and a top edge is open for accessing the interior space. The top edge of the panels form handles that can be tied together to close the interior space. The two panels have a laterally inverted shape relative to a centerline. The top edge of each panel further includes two identical sections that each has a vertically-and-rotationally inverted shape. The shape of the panels facilitates manufacturing as the panels can be cut from a flat sheet with limited or no wasted material.

11 Claims, 9 Drawing Sheets

TWO-PANEL BAG WITH A TIE HANDLE

FIELD OF THE INVENTION

The present application is directed generally to bags and, more specifically, to bags designed to be secured in a closed orientation.

BACKGROUND

Bags generally include an opening that leads into an enclosed interior space. The opening and interior space are sized to hold various objects that are to be carried by the user. The bags may be used in a context in which the user wants to secure the objects in the interior space and prevent their escape through the opening. Existing bags use various structures to close the opening. These can include drawstrings that extend around the opening and can be cinched closed. Other bags use various clasps or connectors that can be closed and locked to secure the opening.

One context of use for bags is in an institutional facility, such as prisons and detention centers. It is often necessary to prevent persons in these facilities from having access to items that could be turned into a weapon to hurt another person in the facility or for the person to hurt themselves. Bags that include closing structures, such as drawstrings, clasps, or connectors cannot be used in these facilities as they pose a safety concern. Therefore, designs are needed for bags to close the interior space without using components that could be used as a weapon.

Further, the bags should be designed with cost as a factor. Many institutional facilities have limited budgets in which to purchase functional items such as bags. The bags should function effectively to contain objects, be secured in a closed orientation, and still not be excessively expensive such that it is not practical for purchase by most interested parties.

SUMMARY

One aspect is directed to a bag comprising first and second panels each comprising a body section and a handle section. The body sections are connected together to form an enclosed interior space with an opening between the handle sections. Each of the panels comprises a laterally-inverted shape along a centerline that extends through the body section and the handle section. Each of the handle sections comprises an outer edge with a first edge section on a first side of the centerline and a second edge section on an opposing second side of the centerline. The first and second edge sections are each divided at a midpoint into first and second segments comprising vertically-and-rotationally inverted shapes.

In another aspect, each of the first and second panels comprises an identical shape and size.

In another aspect, the first and second panels are constructed from a single piece and separated by a fold line.

In another aspect, one or more seams extend along perimeter edges of the body sections and connect the body sections together.

In another aspect, each of the first and second segments comprises a concave section and a convex section.

In another aspect, the outer edge of each of the handle sections comprises a flat section that is centered on the centerline.

In another aspect, the first and second panels are connected together an overlapping arrangement.

In another aspect, lateral edges and bottom edges of the first and second panels are connected together and the opening is formed between top edges of the first and second panels.

In another aspect, the interior space comprises a width that extends between the lateral edges and with the width of the interior space being equal to a width of the opening.

In another aspect, connectors connect together the top edges at points along the top edge that are spaced away from corners that are formed at the lateral edges and with gaps formed along the top edges between the connectors and corners formed at the lateral edges.

In another aspect, sections of the top edges that extend inward towards the centerline are connected together and with the opening formed between the sections.

One aspect is directed to a bag comprising first and second panels in an overlapping arrangement and connected together to form an enclosed interior space. A top edge of each of the first and second panels comprises a first section on a first side of the centerline and a second section on an opposing second side of the centerline. Each of the first and second sections is divided at a midpoint into first and second segments having vertically-and-rotationally inverted shapes. The panels comprise a laterally-inverted shape along a centerline that extends through the body section and the handle section.

In another aspect, each of the panels comprises a body section and a handle section with the top edge of each of the panels extending along the handle sections.

In another aspect, an opening is in communication with the interior space and the opening is positioned at the handle sections and the first and second panels comprise identical shapes and sizes.

In another aspect, one or more seams connect the panels together along outer edges of the body sections.

In another aspect, connectors are positioned along the top edges and spaced inward from corners of the top edges, and further comprising gaps extending into the interior space between the connectors and the corners.

One aspect is directed to a method of making a bag. The method comprises positioning rows of panels on an enlarged sheet with each of the panels comprising a body section and a handle section with the panels positioned on the sheet with the handle sections of a first row interleaved with handle sections of panels of an adjacent second row. The method further comprises cutting the panels from the sheet with a single center cut forming the handle sections of the panels of the first and second rows. The method further comprises aligning two of the panels together in an overlapping arrangement. The method further comprises connecting together the two panels and forming a two-ply bag with an enclosed interior space and an opening leading into the interior space.

In another aspect, positioning the panels on the sheet comprises positioning body sections of the panels of each of the rows along outer edges of the sheet.

In another aspect, the method comprises forming a pair of gaps along a top edge of the two panels that are connected together with a first one of the gaps positioned at a first corner of the top edge and a second one of the gaps positioned at a second corner of the top edge.

In another aspect, the method comprises tying the handle sections of the first and second panels together and closing the opening.

The various aspects of the various embodiments may be used alone or in any combination, as is desired.

DETAILED DESCRIPTION

The present application is directed to a bag that is constructed from first and second panels. Each of the two panels has the same shape and size. The panels are connected together along a section of outer edges to form an interior space. A top edge of the bag is open for accessing the interior space. The top edge of the panels include handles that can be tied together to close the interior space. The two panels further have a laterally inverted shape relative to a centerline. The top edge of each panel further includes two identical segments that each has a vertically-and-rotationally inverted shape. The shape of the panels facilitates manufacturing as the panels are formed from a flat sheet with limited or no wasted material.

In one example, the bag 10 is used for washing laundry. Laundry items are inserted through the opening 11 and into the interior space 12. The handle sections 21 are tied together to maintain the items in the interior space 12. The tied bag 10 is then placed into a washing machine for washing and subsequently into a drier for drying the objects. Once complete, the handle sections 21 are untied and the clean clothes are removed from the interior space 12.

Figure 1:
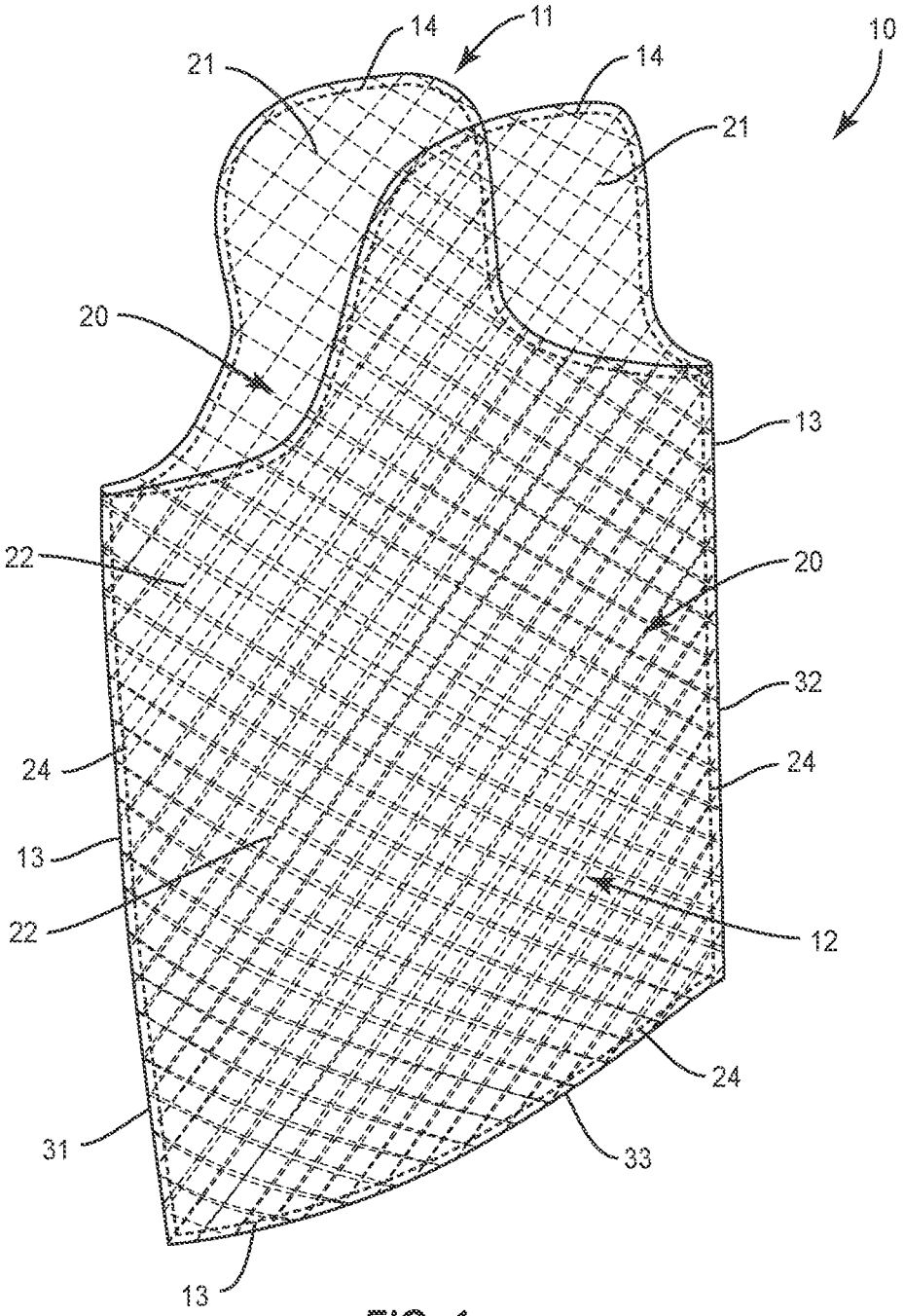
FIG. 1 is a perspective view of a bag.

FIG. 1 illustrates a bag 10 that is formed by two panels 20. Each of the panels 20 includes a handle section 21 and a body section 22. The panels 20 have the same shape and size. The two panels 20 are positioned in an overlapping configuration and are connected together with seams 13 that extend along edges of the body sections 22. An opening 11 is formed between the handle sections 21 and leads into an interior space 12 formed between the body sections 22.

Figure 2:
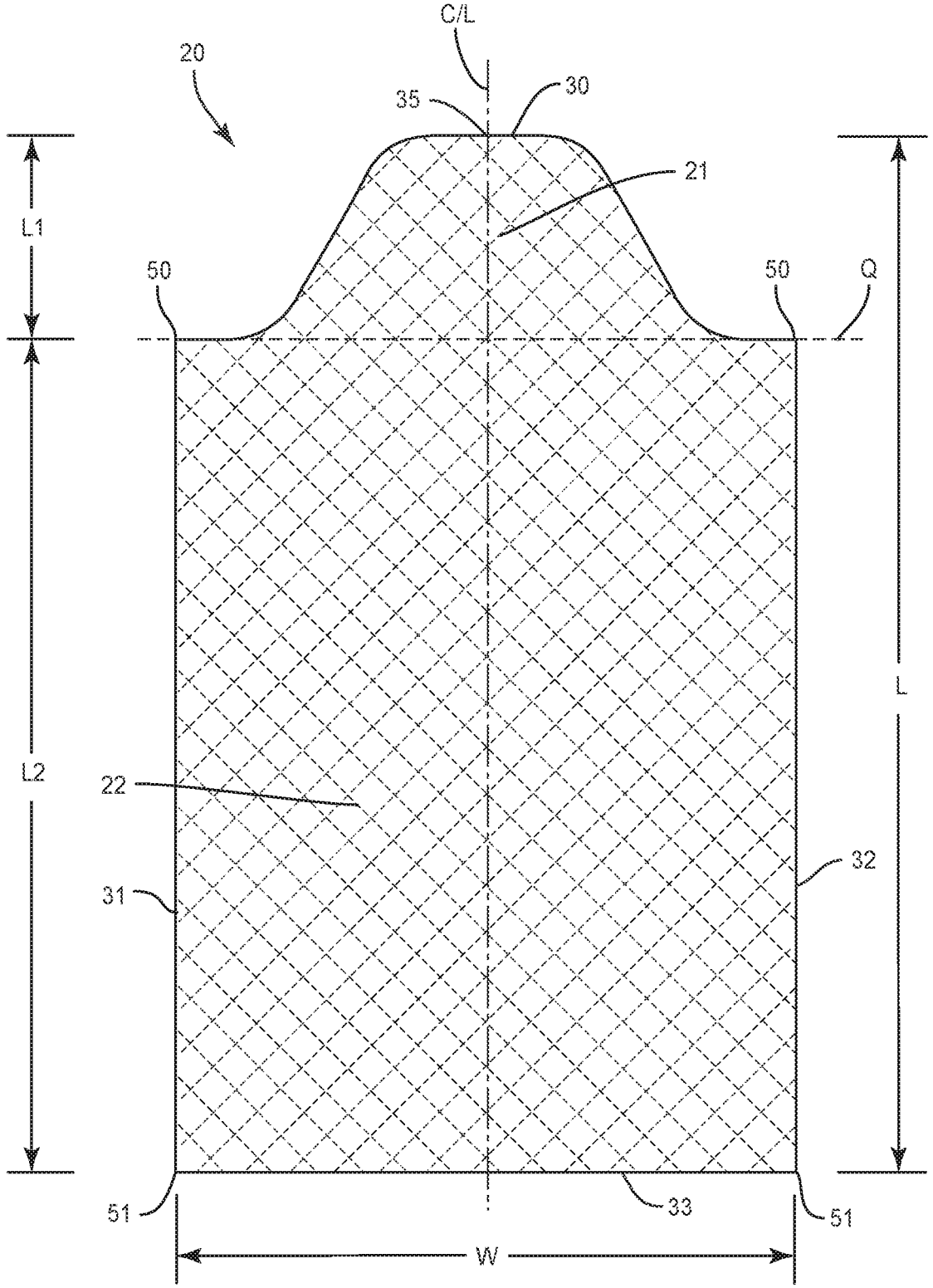
FIG. 2 is a side view of a bag.

FIG. 2 illustrates a panel 20 that includes the handle section 21 and the body section 22. The panel 20 includes a top edge 30 along the handle section 21. The panel 20 also includes lateral edges 31, 32 and bottom edge 33 that extend along the body section 22. The panel 20 includes a centerline C/L that extends through the top edge 30 and the bottom edge 33. Each of the lateral edges 31, 32 and bottom edge 33 are straight. The lateral edges 31, 32 are perpendicular to the bottom edge 33. The lateral edges 31, 32 are perpendicular to the section of the top edges 30 at the corners 50.

The body section 22 includes a width W. This width W is constant along the body section 22 between the upper and lower corners 50, 51. The handle section 21 extends outward from the body section 22 away from the bottom edge 33. The handle section 21 includes a length L1 measured between the top edge 30 at the centerline C/L and a straight line Q that extends between the upper corners 50. The body section 22 includes a length L2 that extends between the line Q and the bottom edge 33. The total length L of the bag 10 is the combination of the lengths L1, L2 of the two sections 21, 22. The length L1 is sized to tie the handle sections 21 together to close the interior space 12. In one example, the length L1 is about 20% of the entire length L of the bag 10. This percentage provides adequate length to tie the handle sections 21 together and provides for the interior space 12 to have an adequate size to hold objects.

Figure 3:
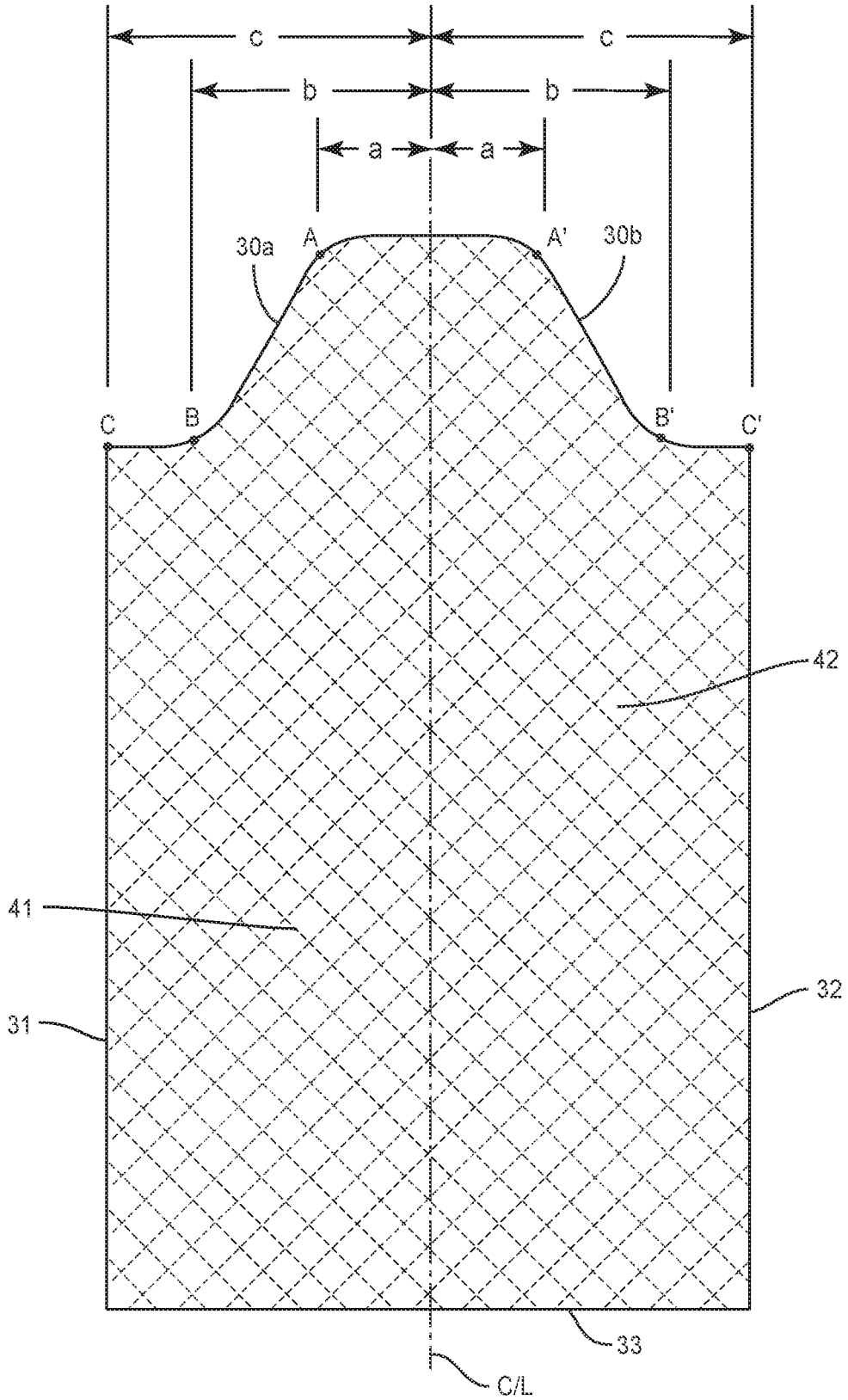
FIG. 3 is a side view of a bag.

As illustrated in FIG. 3, the shape of the panel 20 is mirrored along the centerline C/L. A first lateral section 41 positioned on a first edge of the centerline C/L has the same shape and size as a second lateral section 42 positioned on a second edge of the centerline C/L. That is, the two lateral sections 41, 42 are laterally inverted about the centerline C/L. Common points along each lateral section 41, 42 are positioned an equal distance away from the centerline C/L. A first point A on the top edge 30 of the first lateral section 41 is positioned an equal distance from the centerline C/L as a corresponding first point A' on the top edge 30 of the second lateral section 42. A second point B is likewise positioned an equal distance b from the centerline C/L as corresponding point B'. A third point C is positioned an equal distance c from the centerline C/L as corresponding point C'.

The top edge 30 is divided by the centerline C/L into edge sections 30*a*, 30*b*. The two edge sections 30*a*, 30*b* are mirror images as they are laterally-inverted about the centerline C/L as each includes the same shape and size.

Figure 4:
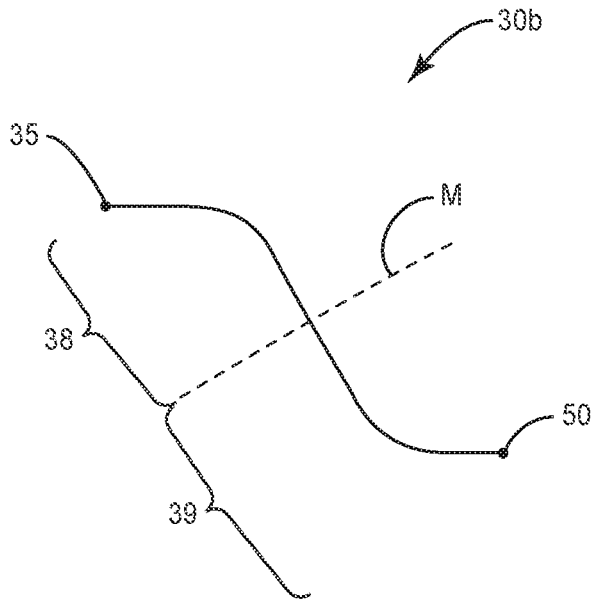
FIG. 4 is a schematic diagram of a segment of a top edge.

Each of the edge sections 30*a*, 30*b* includes a shape that is vertically-and-rotationally-inverted about a midline M. This aspect is illustrated in FIG. 4 that illustrates the edge section 30*b* that extends between point 35 (which is the intersection of the top edge 30 and the centerline C/L) and the corner 50 (the intersection of the top edge 30 and lateral edge 32). The edge section 30*b* is divided by a midline M that is positioned along the edge 30*b* half-way between point 35 and point 50. A first segment 38 is positioned between the point 35 and the midline M. The second segment 39 is positioned between the midline M and the point 50. The first and second segments 38, 39 are inverted and rotated 180° relative to each other about the midline M. The first segment 38 has a concave shape and the second segment 39 has a convex shape as illustrated in the orientation shown in FIG. 4.

Figure 5:
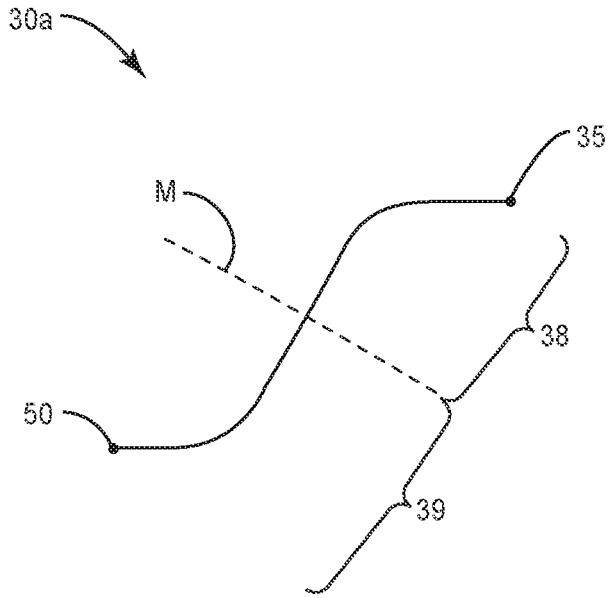
FIG. 5 is a schematic diagram of a segment of a top edge.

FIG. 5 illustrates the edge section 30*a* with the vertically-and-rotationally inverted shape about the midline M. The first segment 38 extends between the point 35 and the midline M and the second segment 39 extends between the midline M and the point 50. Segment 38 has a concave shape and segment 39 has a convex shape as illustrated in the orientation of FIG. 5.

Figure 6:
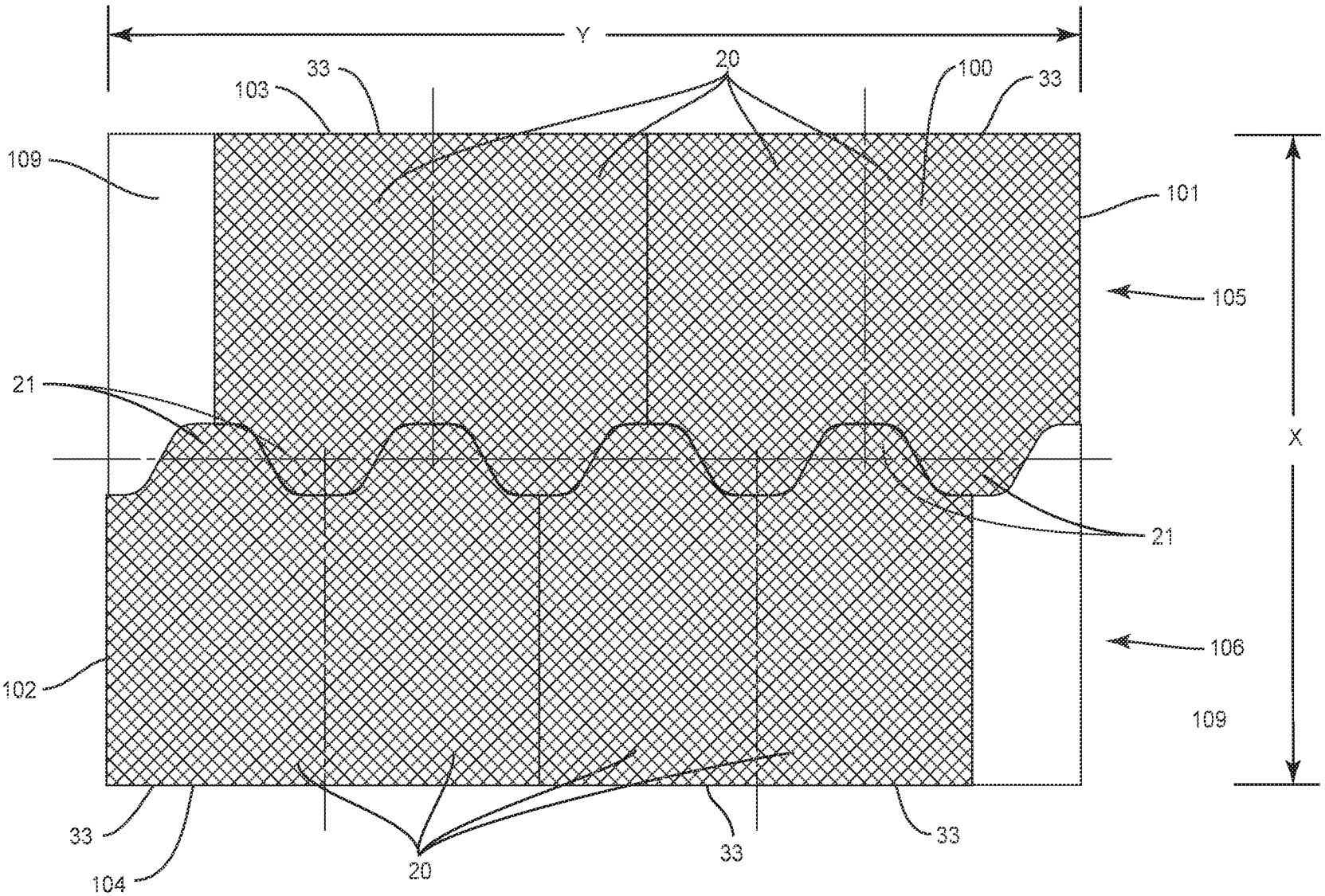
FIG. 6 is a plan view of a panels positioned on a sheet of material.

The shape of the panel 20 facilitates manufacturing by reducing wasted material when the panels 20 are formed from an enlarged sheet 100. FIG. 6 illustrates an enlarged sheet 100 from which the panels 20 are formed. The sheet 100 includes a substantially rectangular shape with a leading edge 101, trailing edge 102, and outer edges 103, 104. The leading and trailing edges 101, 102 are parallel, the outer edges 103, 104 are parallel, and the leading and trailing edges 101, 102 are both perpendicular to the outer edges 103, 104. A width X of the sheet 100 is measured between the outer edges 103, 104. A length Y is measured between the leading and trailing edges 101, 102.

The width X of the sheet 100 is sized to form two rows 105, 106 of panels 20. The panels 20 are aligned on the sheet 100 with the bottom edges 33 formed by the outer edges 103, 104. The handle sections 21 are positioned towards the center of the sheet 100. The panels 20 are offset along the length Y with the handle sections 21 on one row 105 of the sheet 100 interleaved with the handle sections 21 of the panels 20 on the second row 106 of the sheet 100. The shape of the top edge 30 of the panels 20 provides for the opposing panels 20 to nest together. The edge sections 30*a*, 30*b* of panels 20 in each of the rows 105, 106 is shared with edge sections 30*a*, 30*b* of opposing panels 20 in rows 105, 106.

The nested positioning and the complementary shapes of the panels 20 prevent wasted material between the panels 20. In the example of FIG. 6, just two sections of wasted material are located on the sheet 100. A first section 109*a* is positioned at the leading edge 101 along row 106. A second section 109*b* is positioned at the trailing edge 102 along row 105. In one example, each of the sections 109*a*, 109*b* is substantially one-half of a panel 20.

Figure 7:
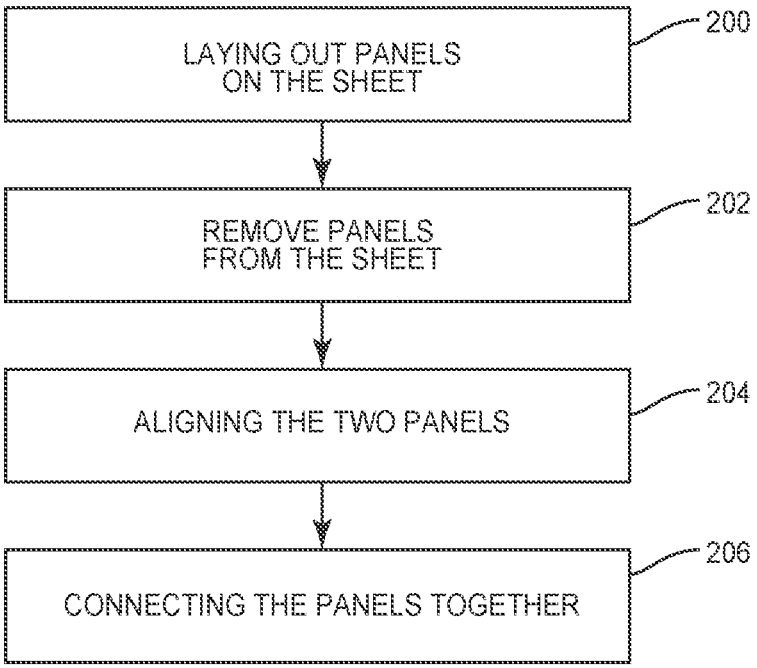
FIG. 7 is a flowchart diagram of a method of making a two-panel bag.

FIG. 7 illustrates a method of manufacturing a two-panel bag 10. The locations of the panels 20 are initially laid-out on the sheet 100 (block 200). The lay-out minimizes the amount of wasted material. The bottom edges 33 of the panels 20 are aligned on the outer edges 103, 104 of the sheet 100. The handle sections 21 are aligned towards a middle of the sheet 100.

After the panels 20 are aligned on the sheet 100, the panels 20 are removed from the sheet 100 (block 202). In one example, this includes cutting the panels 20 from the sheet 100. The shape of the top edge 30 of the handle sections 21 complement each other and can be simultaneously formed with a single cut. Likewise, the lateral edges 31, 32 are shared between adjacent panels 20 and formed with a single cut. The layout of the panels 20 on the sheet 100 thus reduces the amount of wasted material that does not form part of a panel 20. The layout also minimizes the number of cuts as one or more of the edges 30, 31, 32 are shared with one or more other panels 20.

After the panels 20 are removed from the sheet 100, two of the panels 20 are aligned together (block 204). The panels 20 include the same shape and size and are positioned in an overlapping orientation. This positioning aligns together each of the top edges 30, the lateral edges 31, 32, and the bottom edges 33.

The two panels 20 are then connected together (block 206). The connection can be formed by one or more of sewing and adhesive. In one example as illustrated in FIG. 1, one or more seams 13 connect the panels 20 together. The connection can extend along two or more of the edges 31, 32, 33. In one example as illustrated in FIG. 1, the lateral edges 31, 32 and bottom sides 33 are connected together. The panels 20 can be connected at the edges 31, 32, 33, or can be connected together inward from the edges 31, 32, 33.

One or more of the edges 30, 31, 32, 33 can be treated to prevent unraveling or otherwise fraying during use. This can occur prior to or after the panels 20 are connected together. In one example as illustrated in FIG. 1, the top edges 30 are treated and include seams 14.

An opening 11 is formed along the top edge 30 to provide access to the interior space 12. In one example, the opening 11 extends the entire distance between the corners 50 with the opening 11 extending the entire width W (see FIG. 1).

Figure 8:
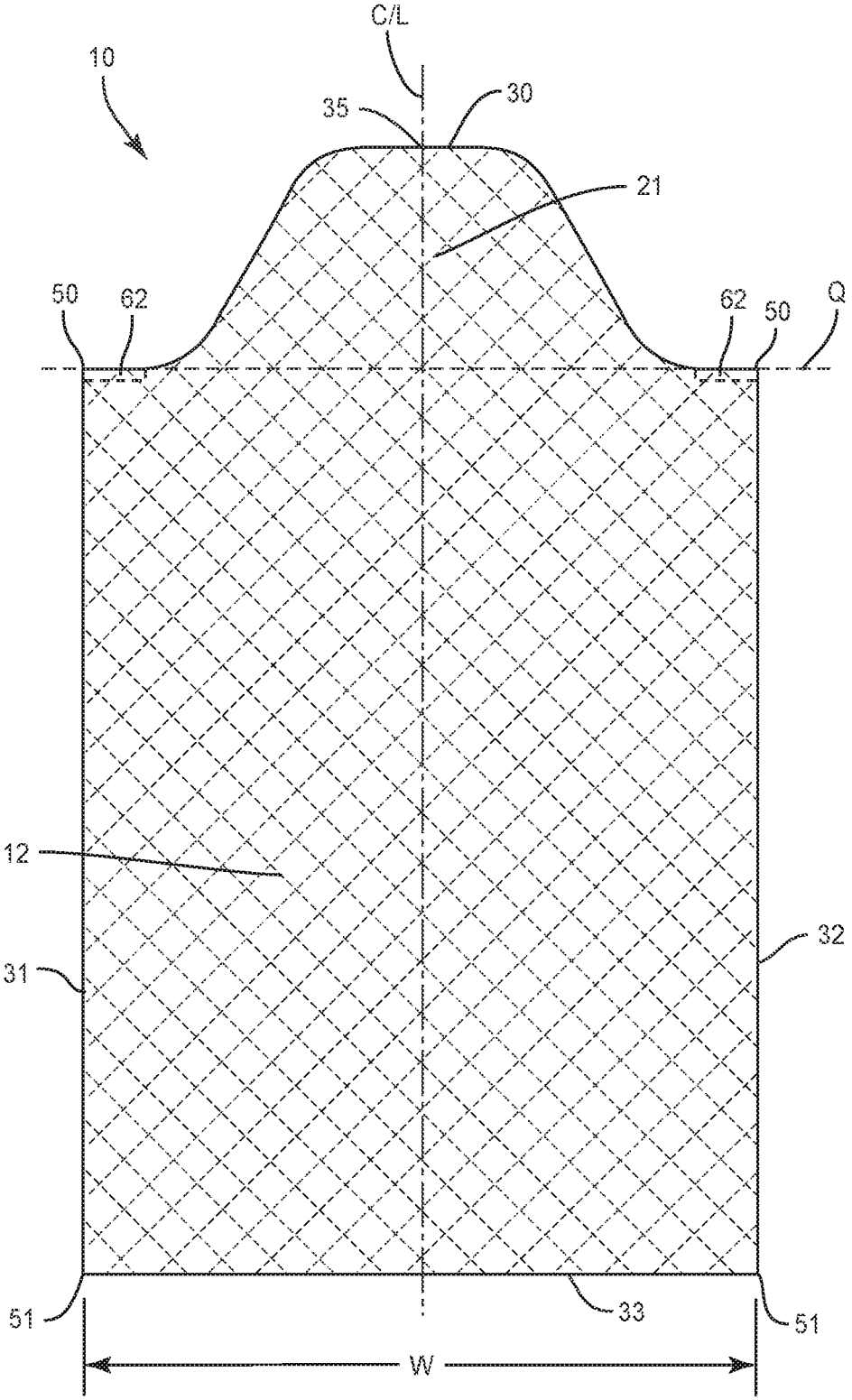
FIG. 8 is side view of a bag.

In another example as illustrated in FIG. 8, the top edges 30 are connected together along sections 62 at the corners 50. The length of the sections 62 can vary. In one example, the sections 62 are the portions of the top edge 30 that are straight and extend inward from the corners 50. The sections 62 result in the opening 11 into the interior space 12 being smaller than the width W of the panels 20. In one example in which the bag 10 is used for cleaning laundry, the sections 62 prevent items within the interior space 12 from escaping through gaps formed along the top edges 30 at the corners 50 when the handle sections 21 are tied together.

The bag 10 can be constructed from a variety of different materials. Examples include but are not limited to mesh, knitted or woven fabric and plastic. In one example, each of the two panels 20 is made from the same material. In another example, the two panels 20 are made from different materials.

In the example described above, the opening 11 is positioned at the top edge of the bag 10. In other examples, the opening 11 is positioned along other edges of the bag 10, such as one of the lateral edges or a bottom edge. In another example, the bag 10 includes two or more openings 11. Handles 21 are positioned at each of the openings 11 to close the opening 11 and secure objects that are positioned within the interior space 12.

One method of using the bag 10 includes separating the handle sections 21 to expose the opening 11. Objects are inserted through the opening 11 and into the interior space 12. After the objects are in the interior space 12, the handle sections 21 are tied together. This closes the opening 11 and prevents the objects from escaping from the interior space 12. The handle sections 21 can be untied to re-open the opening 11 and provide for removal of the objects from the interior space 12 through the opening 11.

In one specific example, the bag 10 is used for laundering objects. With the handle sections 21 untied, the handle sections 21 are separated to expose the opening 11. The objects to be washed are then inserted through the opening 11 and into the interior space 12. The handle sections 21 are then tied together to prevent the objects from escaping from the interior space 12. The bag 10 and the objects are then placed into a washing machine to wash the objects and then a dryer to dry the objects. The bag 10 and objects are removed from the dryer, the handle sections 21 are untied, and the cleaned and dried objects are removed from the interior space 12 through the opening 11. In this example, the bag 10 is constructed from a material that provides for washing and drying.

Figure 9:
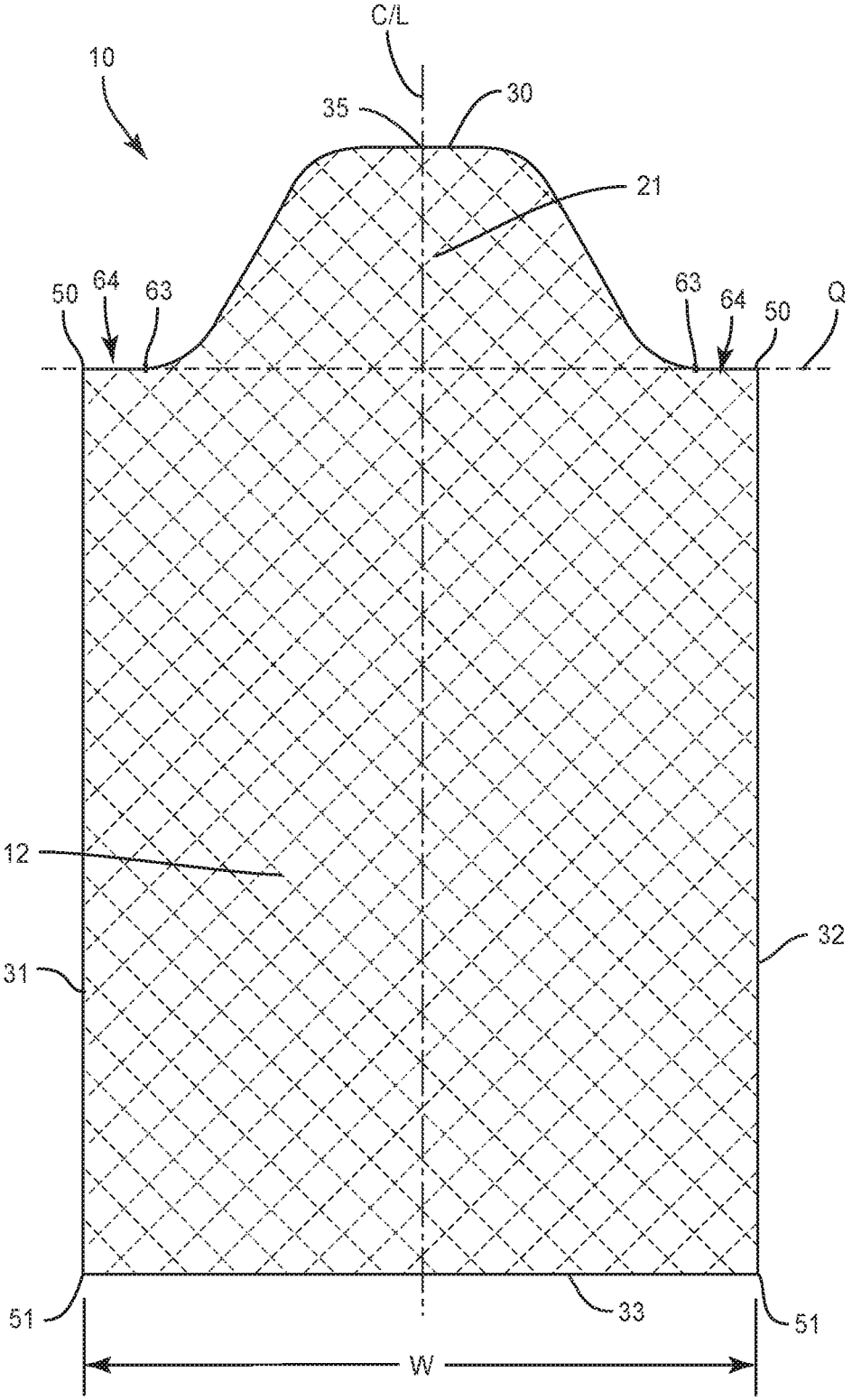
FIG. 9 is a side view of a bag.

FIG. 9 illustrates another example that includes a pair of connectors 63 positioned along the top edges 30. The lateral edges 31, 32 and bottom edge 32 are connected together. Gaps 64 are formed along the tops edges 30 between the connectors 63 and the corners 50. The gaps 64 are sized for inserting one of the handle sections 21 to close the top edge 30 without creating any openings that could result in escape of one or more objects. The connectors 63 can extend various lengths along the top edges 30, and can be formed in a variety of manners, including but not limited to stitching, adhesive, and mechanical fasteners such as rivets. In one example, the connectors 63 are bar tacks. During use, after the objects are inserting into the interior space 12, a first one of the handle sections 21 is inserted into one of the gaps 64 and a second one of the handle sections 21 is inserted into the other gap 64. Portions of each of the handle sections 21 extend above the gap 64 and these portions are tied together to close the opening 11. The insertion of the handle sections 21 through the gaps 64 prevents any openings from forming along the top edges 30 adjacent to the corners 50 when the handle sections 21 are tied together.

Figure 10:
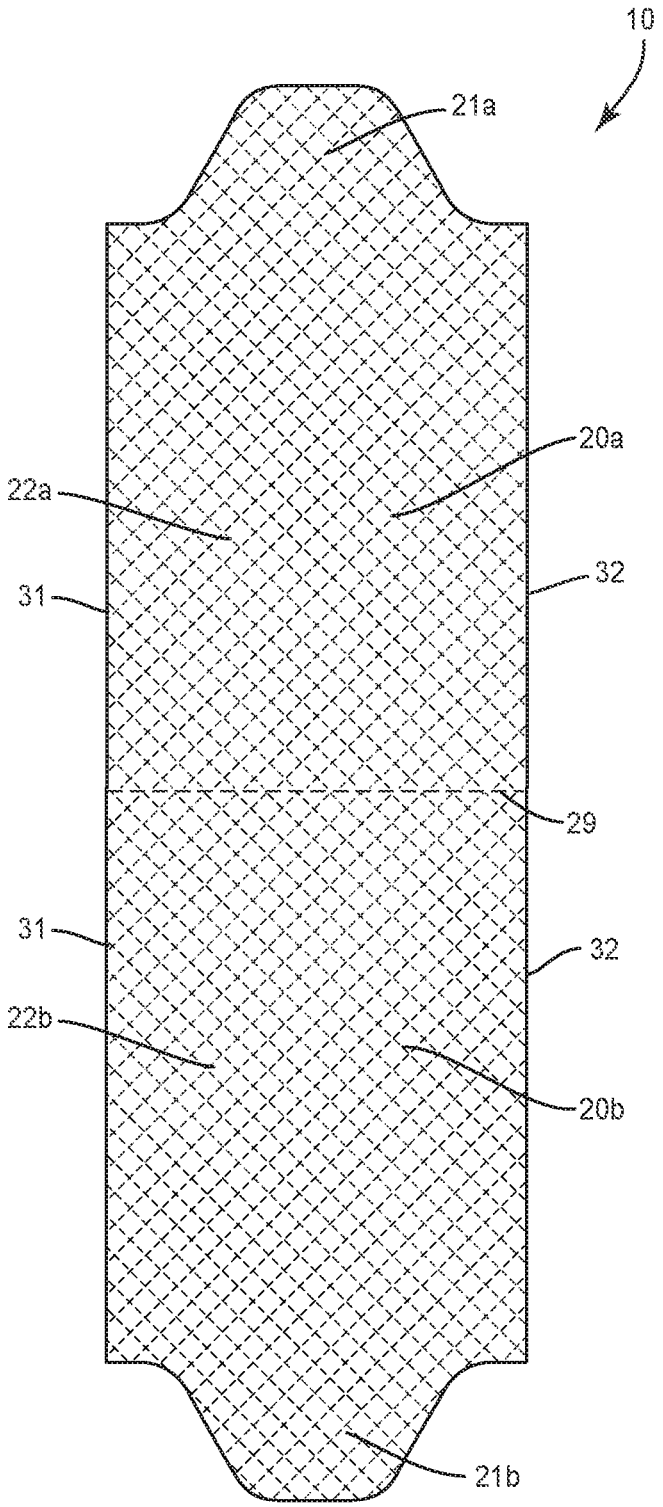
FIG. 10 is a plan view of a pair of panels connected together at a fold line.

FIG. 10 illustrates an example in which the bag 10 is formed by a single piece. A fold 29 separates the first and second panels 20*a*, 20*b*. Each of the panels 20*a*, 20*b* includes a body sections 22*a*, 22*b* and a handle section 21*a*, 21*b* respectively. During construction, the single piece is folded together with the first and second panels 20*a*, 20*b* in an overlapping arrangement. The lateral sides 31, 32 can be connected together to form the enclosed interior space 12. An opening 11 is formed between the handle sections 21*a*, 21*b* that leads into the interior space 12.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive.

What is claimed is:

1. A bag comprising:

first and second panels each comprising a body section and a handle section with the body section comprising lateral sides;

a continuous seam that connects the body sections together and that extends along a bottom of the body sections opposite from the handle sections and at least one of the lateral sides;

the first and second panels connected together in an overlapping arrangement and having a centerline that extends through a center of an outer edge of the handle sections and the bottom of the body section;

a straight line extends between upper corners of the body section with the straight line extending across the centerline, with the body sections positioned below the straight line and an entirety of the handle sections positioned above the straight line;

the body sections connected together to form an interior space with an opening between the handle sections;

the handle sections spaced inward from the lateral sides with the tops of the body sections connected together along the straight line between the upper corners and the handle sections;

each of the panels comprising a laterally-inverted shape along the centerline that extends through the body section and the handle section;

each of the handle sections comprising the outer edge with a first edge section on a first side of the centerline and a second edge section on an opposing second side of the centerline;

the first and second edge sections each divided at a midpoint into first and second segments comprising vertically-and-rotationally inverted shapes;

the handle sections positioned at the opening and are sized to close the opening when tied together.

2. The bag of claim 1, wherein each of the first and second panels comprises an identical shape and size.

3. The bag of claim 1, wherein the continuous seam extends along the bottom and both lateral sides.

4. The bag of claim 1, wherein each of the first and second segments comprises a concave section and a convex section.

5. The bag of claim 1, wherein the outer edge of each of the handle sections comprises a flat section that is centered on the centerline.

6. The bag of claim 1, wherein the first and second panels are constructed from a fabric.

7. The bag of claim 6, wherein the continuous seam is spaced inward from outer edges of the bottom and the at least one lateral side.

8. The bag of claim 6, wherein the continuous seam is sewn along outer edges of the bottom and the at least one lateral side.

9. A bag comprising:

first and second panels in an overlapping arrangement and connected together to form an interior space, the panels constructed from fabric and each of the first and second panels further comprising a top, a bottom, and opposing lateral sides with the lateral sides intersecting with the top at corners;

a centerline that extends through centers of the top and bottom of each of the first and second panels;

each of the first and second panels comprising a handle section with a single extension that is centered on the centerline and is spaced inwardly from the lateral sides;

a continuous sewn seam that connects together the first and second panels along the bottom and the lateral sides;

the handle section of each of the first and second panels comprising a shape with a first section on a first side of the centerline and a second section on an opposing second side of the centerline;

each of the first and second sections divided at a midpoint into first and second segments having vertically-and-rotationally inverted shapes;

the panels comprising a laterally-inverted shape along the centerline;

top seams that connect together the first and second panels, the top seams extend inward from the corners to the handle sections with an entirety of the handle sections positioned above the top seams; and an opening formed between the top seams and in communication with the interior space, the opening centered on the centerline.

10. The bag of claim 9, wherein each of the panels comprises a body section and the handle section.

11. The bag of claim 10, further comprising the opening positioned at the handle sections and wherein the first and second panels comprising identical shapes and sizes.

* * * * *